US006371829B1

(12) United States Patent
Kato et al.

(10) Patent No.: US 6,371,829 B1
(45) Date of Patent: Apr. 16, 2002

(54) TOY HAVING REMOTE CONTROL DEVICE AND REMOTE CONTROLLED MODEL VEHICLE

(75) Inventors: Hideyuki Kato; Tomohiro Yamazaki, both of Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 09/692,207

(22) Filed: Oct. 20, 2000

(51) Int. Cl.[7] ..... A63H 30/04

(52) U.S. Cl. ..... 446/456; 446/232; 446/454; 446/460

(58) Field of Search ..... 446/7, 230, 231, 446/232, 454, 456, 457, 484, 437, 460, 468

(56) References Cited

U.S. PATENT DOCUMENTS 4,269,596 A * 5/1981 D'Andrade ..... 434/32
4,421,485 A * 12/1983 Geschwender ..... 434/32
5,127,658 A * 7/1992 Openiano ..... 273/311
5,344,354 A * 9/1994 Wiley ..... 446/7
5,571,038 A * 11/1996 Halling ..... 446/232
5,580,296 A * 12/1996 Chow ..... 446/443
5,803,789 A * 9/1998 Dean et al. ..... 446/455
5,882,241 A * 3/1999 Mullaney et al. ..... 446/462
5,921,839 A * 7/1999 Siren ..... 446/7

* cited by examiner

*Primary Examiner*—Jacob K. Ackun, Jr.
*Assistant Examiner*—Faye Francis
(74) *Attorney, Agent, or Firm*—Staas & Halsey LLP

(57) ABSTRACT

A toy comprising a remote control device and a remote controlled model vehicle for changing a form thereof while moving, according to a control by the remote control device. The toy comprises a remote control device (100) and a remote controlled model vehicle (200) capable of turning at least rightward and leftward according to a control signal from the remote control device, wherein the remote control device comprises: a tilt detecting unit (SW5 and SW6) for detecting rightward and leftward tilt directions thereof; and the remote controlled model vehicle comprises: a lower body part (202*b*); an upper body part (202*a*) capable of tilting rightward and leftward to the lower body part; a tilting unit (211) for tilting the upper body part in the same direction as a tilt direction of the remote control device, detected by the tilt detecting unit; and a steering unit (203) for turning in the same direction as the tilt direction of the remote control device in synchronization with a tilt of the upper body part.

10 Claims, 12 Drawing Sheets

TOY HAVING REMOTE CONTROL DEVICE AND REMOTE CONTROLLED MODEL VEHICLE

BACKGROUND OF THE INVENTION

1. Field of the Invention

The present invention relates to a toy comprising a remote control device and a remote controlled model vehicle to be controlled by a control signal from the remote control device.

2. Description of Related Art

According to an earlier development, a toy having a remote controller and a remote controlled model airplane (vehicle) is known.

According to the toy as described above, the remote controller and the remote controlled model airplane are designed that the remote controlled model airplane moves forward when a forward button of the remote controller is pressed, the remote controlled model airplane moves backward when a backward button of the remote controller is pressed, and the remote controlled model airplane turns when a turn button of the remote controller is pressed.

Further, as a model airplane capable of expressing a state of taking-off and landing, a self-propelled model airplane is known. Although the self-propelled model airplane is not a remote controlled model vehicle, the self-propelled model airplane is designed to raise the front portion thereof when taking off and to lower the rear portion thereof when landing on (Japanese Utility Model Application Publication (Examined) No. Jitsuko hei-7-6951). According to the self-propelled model airplane, it simulates an engine sound generated when an airplane takes off and lands on. The self-propelled model airplane changes the artificial engine sound to one having a higher frequency when taking off, while the self-propelled model airplane changes the artificial engine sound to one having a lower frequency when landing on.

However, according to the toy having the remote controller and the remote controlled model airplane and the self-propelled model airplane as described above, the following problems occur.

That is, according to the former toy having the remote controller and the remote controlled model airplane, the remote controlled model airplane is moved by the control by the remote controller so that a player can have senses that he pilots a real airplane at a cockpit thereof. However, the remote controlled model airplane does not change the form thereof other than the direction of wheels thereof. The remote controlled model airplane only moves forward and backward and turns on the flour by the control by the remote controller. Accordingly, the toy has been a little interesting to the visual sense of the player.

On the other hand, according to the later self-propelled model airplane as described above, the self-propelled model airplane changes the form thereof and the artificial engine sound when taking off and landing on so that the self-propelled model airplane is interesting to the visual sense and the auditory sense of the player. However, the self-propelled model airplane is uncontrolled by any controller. Accordingly, the player cannot have senses that he pilots a real airplane at a cockpit thereof at all.

SUMMARY OF THE INVENTION

The present invention was developed in view of the above-described problems.

An object of the present invention is to provide a toy comprising a remote control device and a remote controlled model vehicle for changing a form thereof while moving, according to a control by the remote control device.

In accordance with one aspect of the present invention, a toy comprises a remote control device (for example, a controller 100 shown in FIG. 1) and a remote controlled model vehicle (for example, a model airplane 200 shown in FIG. 2) capable of turning at least rightward and leftward according to a control signal from the remote control device, wherein the remote control device comprises: a tilt detecting unit (for example, switches SW 5 and SW 6 of a detector unit shown in FIG. 6) for detecting rightward and leftward tilt directions thereof; and the remote controlled model vehicle comprises: a lower body part (for example, a lower body part 202*b* shown in FIG. 7); an upper body part (for example, an upper body part 202*a* shown in FIGS. 2 and 7) capable of tilting rightward and leftward to the lower body part; a tilting unit (for example, a forked member 211 shown in FIG. 10) for tilting the upper body part in the same direction as a tilt direction of the remote control device, detected by the tilt detecting unit; and a steering unit (for example, a front wheel 203 shown in FIGS. 8 and 9) for turning in the same direction as the tilt direction of the remote control device in synchronization with a tilt of the upper body part.

In accordance with another aspect of the present invention, a toy comprises a remote control device and a remote controlled model vehicle capable of turning at least rightward and leftward according to a control signal from the remote control device, wherein the remote control device comprises: a tilt detecting unit for detecting rightward and leftward tilt directions thereof; and the remote controlled model vehicle comprises: a body (for example, an upper body part 202*a* and a lower body part 202*b* shown in FIG. 7) capable of tilting rightward and leftward; a tilting unit for tilting the body in the same direction as a tilt direction of the remote control device, detected by the tilt detecting unit; and a steering unit for turning in the same direction as the tilt direction of the remote control device in synchronization with a tilt of the body.

Herein, the remote controlled model vehicle includes, for example, a model airplane, a model helicopter, a model railroad car, a model ship and the like. Further, the remote controlled model vehicle can turn rightward and leftward, that is, in a clockwise direction and a counterclockwise direction about an approximately vertical axis.

The remote control device can be tilted rightward and leftward, that is, can be rotated in a clockwise direction and a counterclockwise direction about an approximately horizontal axis, when the remote control device is stood, as shown in FIG. 1. Therefore, the tilt detecting unit can detect rightward and leftward tilt directions of the remote control device, that is, can detect whether the remote control device is rotated in a clockwise direction or a counterclockwise direction about the approximately horizontal axis.

According to the remote controlled model vehicle, the tilting unit can tilt the upper body part and the body rightward and leftward, that is, can rotate the upper body part and the body in a clockwise direction and a counterclockwise direction about an approximately horizontal axis extended along a travel direction of the remote controlled model vehicle. Further, the steering unit can turn in synchronization with a tilt of the upper body part and the body, that is, can rotate in a clockwise direction and a counterclockwise direction about an approximately vertical axis in synchronization with a rotation of the upper body part and the body.

According to the toy as described above, the remote controlled model vehicle can tilt the upper body part and the body in the same direction about the approximately horizontal axis by the tilting unit and turn in the same direction about the approximately vertical axis by the steering unit, according as whether the remote control device is tilted in a clockwise direction or a counterclockwise direction about the approximately horizontal axis, while the remote controlled model vehicle is moving.

For example, the remote controlled model vehicle tilts the upper body part or the body in a clockwise direction about the approximately horizontal axis when turning in a clockwise direction about the approximately vertical axis, while the remote controlled model vehicle tilts the upper body part or the body in a counterclockwise direction about the approximately horizontal axis when turning in a counterclockwise direction about the approximately vertical axis. Accordingly, it is possible to provide a toy comprising a remote control device and a remote controlled model vehicle capable of moving with reality.

Further, the remote controlled model vehicle is controlled by standing or tilting the remote control device. Accordingly, it is possible to sufficiently provide senses that a player pilots a real airplane at a cockpit thereof.

Preferably, a toy as described above, comprises a remote control device and a remote controlled model; wherein the remote controlled model vehicle further comprises: a wheel (for example, a front wheel 203 shown in FIGS. 8 and 9) provided at the lower body part, as the steering unit; and a shaft (for example, a shaft 202*c* shown in FIG. 7) extending forward and backward thereof and provided at the lower body part, around which the upper body part is capable of tilting rightward and leftward; and a direction of the wheel and a tilt direction of the upper body part is determined according to the tilt direction of the remote control device, detected by the tilt detecting unit.

Preferably, a toy according to another aspect as described above, comprises a remote control device and a remote controlled model vehicle, wherein the remote controlled model vehicle further comprises a wheel provided at the body, as the steering unit.

According to the toy as described above, the direction of the wheel and the tilt direction of the upper body part or the body are changed according to the tilt direction of the remote control device. Accordingly, the remote controlled model vehicle turns to and tilts in the same direction as each other, while the remote controlled model vehicle is moving. Consequently, it is possible to provide a toy having a remote control device and a remote controlled model vehicle capable of moving with reality.

Preferably, a toy as described above, comprises a remote control device and a remote controlled model vehicle, wherein the remote control device further comprises at least a handle (for example, handles 102 and 103 shown in FIG. 1) provided thereat and held by a hand to operate the remote control device.

The remote control device may comprise one handle provided at the center or the like, of the remote control device, or two handle provided at both sides of the remote control device respectively.

According to the toy as described above, the handle is provided at the remote control device and held by a hand to operate the remote control device thereby. Consequently, it is possible to produce senses that a player pilots a real airplane at a cockpit thereof.

Preferably, a toy as described above, comprises a remote control device and a remote controlled model vehicle, wherein the remote control device further comprises a dummy compass (for example, a dummy compass 108 shown in FIG. 1) for indicating rightward and leftward tilt directions of the remote control device and a travel direction of the remote controlled model vehicle indirectly.

Preferably, a toy according to another aspect as described above, comprises a remote control device and a remote controlled model vehicle, wherein the remote control device further comprises a dummy compass for indicating a travel direction of the remote controlled model vehicle.

According to the toy as described above, the dummy compass is provided at the remote control device so that it is possible to provide a remote control device with more reality. Further, a player can know the travel direction of the remote controlled model vehicle with the dummy compass of the remote control device to some extent. Accordingly, the player can play with the toy so that the player moves the remote controlled model vehicle to the destination with only watching the dummy compass of the remote control device. As a result, it is possible to realize a more interesting toy.

Preferably, a toy as described above, comprises a remote control device and a remote controlled model vehicle, wherein the dummy compass comprises: a vehicle figure (for example, an airplane figure 111 shown in FIG. 1) fixedly provided at a transparent plate (for example, a transparent plate 110 shown in FIG. 1) provided at a window of the remote control device; a compass card (for example, a dummy compass card 112 shown in FIG. 4) provided at an inside of the window of the remote control device and rotatable on a basis of a pendulum principal according to rightward and leftward tilts of the remote control device; and a predetermined lubber line (for example, a cross line 113 shown in FIGS. 1 and 4) provided at the compass card, for indicating the travel direction of the remote controlled vehicle by a position relation with the vehicle figure.

According to the toy as described above, the compass card rotates on the basis of the pendulum principal according to the tilt of the remote control device. Thereby the dummy compass indicates the travel direction of the remote controlled model vehicle. Consequently, it is unnecessary to provide an expensive sensor at the remote control device and it is possible to realize a dummy compass at a low cost.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

PREFERRED EMBODIMENT OF THE INVENTION

Hereinafter, an embodiment of a toy comprising a remote control device and a remote controlled model vehicle of the present invention will be explained with reference to FIGS. 1 to 12, in detail.

Firstly, the schematic structure of the toy according to an embodiment of the present invention will be explained as follows.

According to an embodiment of a toy comprising a remote control deice and a remote controlled model vehicle of the present invention, the toy comprises a controller 100 (with reference to FIG. 1) as the remote control device and a model airplane 200 as the remote controlled model vehicle (with reference to FIG. 2) to be remotely controlled on the basis of a control signal from the controller 100.

Figure 1:
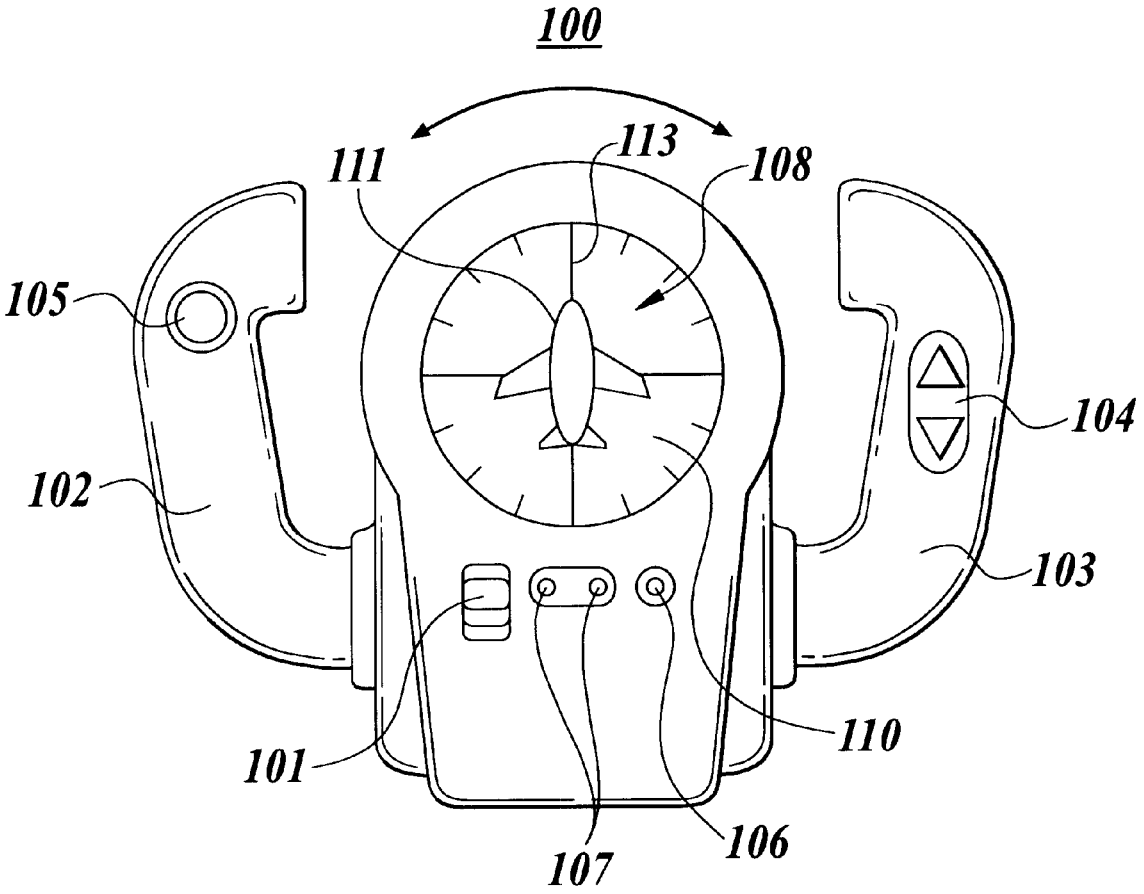
FIG. 1 is a view showing a controller according to an embodiment of a toy comprising a remote control device and a remote controlled model vehicle of the present invention.
Figure 2:
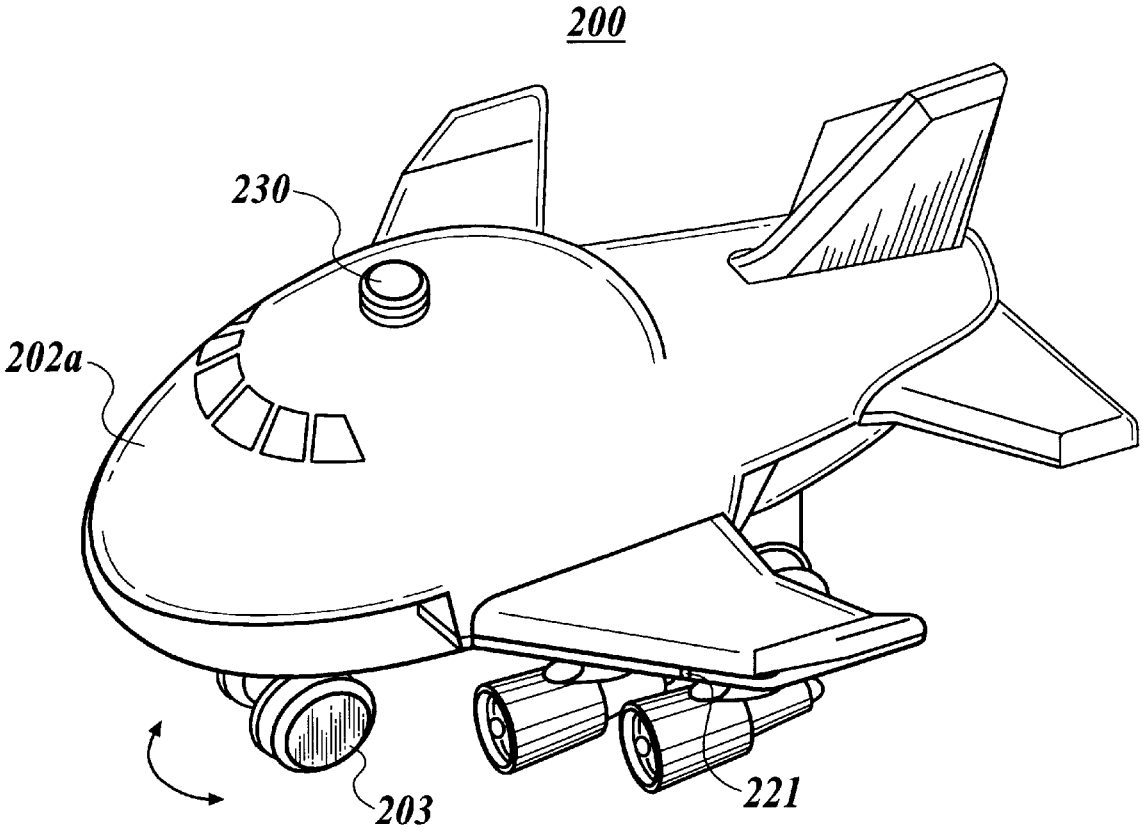
FIG. 2 is a view showing a model airplane according to an embodiment of a toy comprising a remote control device and a remote controlled model vehicle of the present invention.

In FIG. 1, the controller 100 of the toy according to an embodiment of the present invention is shown. In FIG. 2, the model airplane 200 of the toy according to an embodiment of the present invention is shown. Further, in FIG. 3, the bottom view of the model airplane 200 shown in FIG. 2 is shown.

Figure 3:
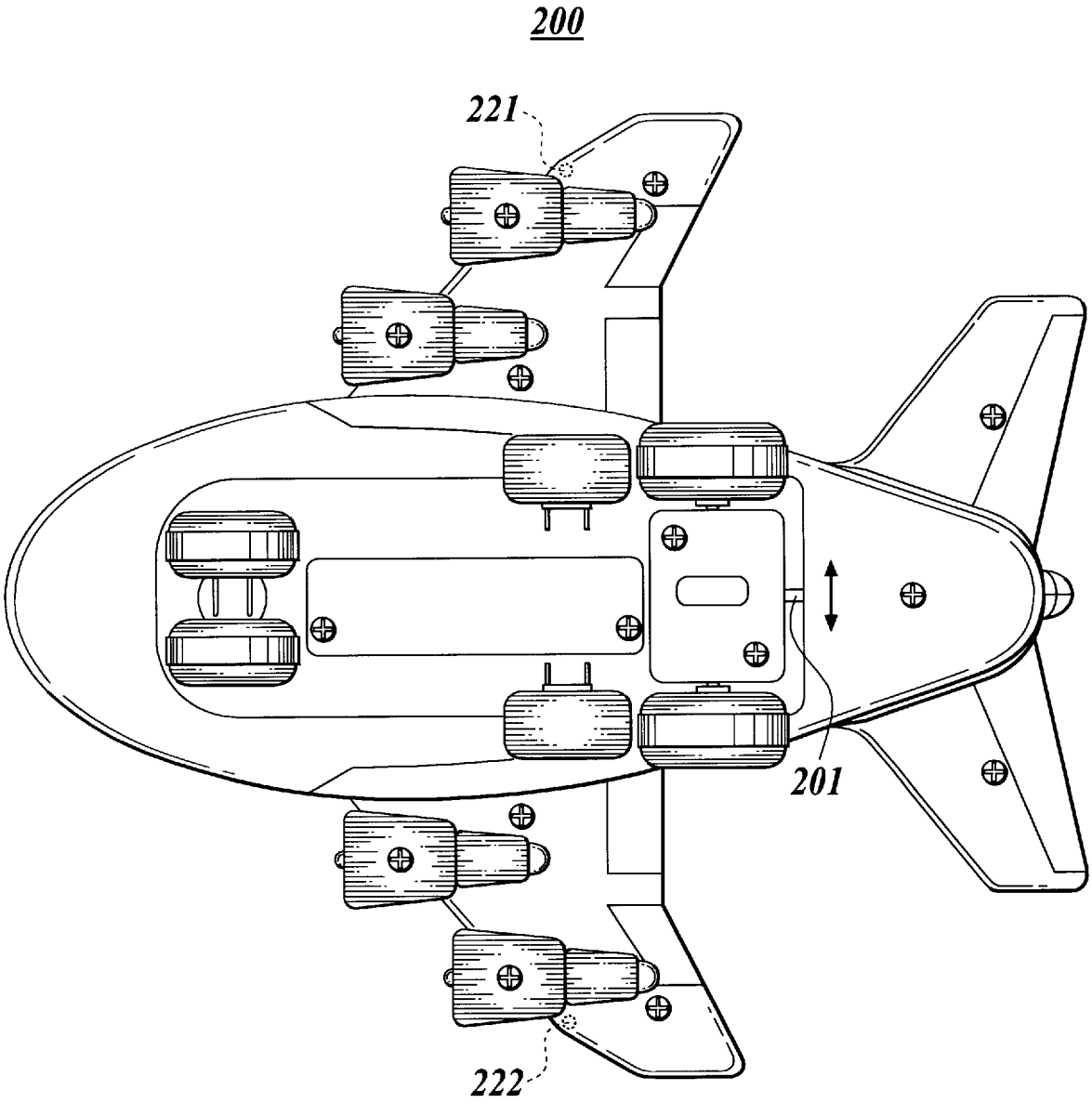
FIG. 3 is a bottom view of the model airplane shown in FIG. 2.

As shown in FIG. 1, a slide type of power supply switch 101 is provided at the controller 100. As shown in FIG. 3, a slide type of power supply switch 201 is provided at a back portion of a bottom of the model airplane 200.

Further, as shown in FIG. 1, handles 102 and 103 are provided at left and right positions of the controller 100, respectively. At the handle 103 positioned at the right side of the controller 100, a seesaw type of buttons 104 are provided, while at the handle 102 positioned at the left side of the controller 100, a press type of button 105 is provided.

Secondly, the basic movement of the toy as described above and how to play with the toy will be explained as follows.

According to the controller 100 and the model airplane 200, both of the power supply switches 101 and 201 are turned on. In this state, the model airplane 200 does not operate at all.

The handles 102 and 103 of the controller 100 are held, and the controller 100 is held in a standing state having not less than 45 degrees from a horizontal plane. Thereafter, the rear surface of the controller 100 is turned to the model airplane 200.

In this state, the upper button of the buttons 104 is pressed with thumb, thereby the controller 100 generates an artificial engine sound from the rear surface thereof (with reference to FIG. 5) and the model airplane 200 moves forward. When the thumb is removed from the upper button of the buttons 104, the model airplane 200 stops moving forward immediately and the controller 100 stops generating the artificial engine sound after generating it for two second.

Further, the lower button of the buttons 104 is pressed with thumb, thereby the model airplane 200 moves backward. In this case as well as the case as described above, the controller 100 generates the artificial engine sound from the rear surface thereof. When the thumb is removed from the lower button of the buttons 104, the model airplane 200 stops immediately and the controller 100 stops generating the artificial engine sound after generating it for two seconds.

When the button 105 is pressed in the state that the upper button or the lower button of the buttons 104 is pressed, the travel speed of the model airplane 200 is increased. When both of the button 105 and the upper button or the lower button of the buttons 104 are pressed, the model airplane 200 operates like the case that the only upper button or the lower button of the buttons 104 is pressed other than that the model airplane 200 moves forward or backward at a higher speed.

When the button 105 is pressed in the state that the upper button or the lower button of the buttons 104 is not pressed, the model airplane 200 does not operate at all.

Further, in the sate that the controller 100 is held in a standing state having not less than 45 degrees from a horizontal plane, the controller 100 is tilted to either the rightward or leftward direction, that is, in a clockwise direction or a counterclockwise direction about the horizontal axis. Thereby, the upper body part 202*a* of the model airplane 200 is tilted in the same direction as the tilt direction of the controller 100, that is, in a clockwise direction or a counterclockwise direction about the following shaft 202*c* according as whether the controller 100 is tilted in a clockwise direction or a counterclockwise direction about the horizontal axis. Further, the direction of the wheel (front wheel) 203 attached at the lower body part 202*b* of the model airplane 200, for steering the model airplane 200 is changed so that the model airplane 200 turns in the same direction as the tilt direction of the upper body part 202*a*, that is, in a clockwise direction or a counterclockwise direction about the vertical direction according as whether the upper body part 202*a* is tilted in a clockwise direction or a counterclockwise direction about the following shaft 202*c*.

In the state that the model airplane 200 stops and in the state that the model airplane 200 moves, the upper body part 202*a* can be tilted and the direction of the front wheel 203 can be changed.

While the model airplane 200 is moving, when the controller 100 is tilted, the upper body part 202*a* is tilted in the predetermined tilt direction and the direction of the front wheel 203 is changed according to the predetermined tilt direction. Accordingly, the model airplane 200 turns in the predetermined tilt direction.

Next, the structure of the controller 100 will be explained in detail, as follows.

The structure of the top surface of the controller 100 will be explained with reference to FIG. 1.

As shown in FIG. 1, the controller 100 comprises the power supply switch 101, the handles 102 and 103 and the buttons 104 and 105 as described above, and further a green color emitter 106 comprising a LED (light emitting diode) as a light source, two red color emitters 107 comprising LED as a light source and a dummy compass 108 which are provided at the top surface side of the body thereof.

The green color emitter 106 lights on when the power supply switch 101 is turned on. The red color emitters 107 repeatedly go on and off alternately when the artificial engine sound is generated.

The dummy compass 108 indicates the tilt direction of the controller 100 and further, the travel direction of the model airplane 200 indirectly. The dummy compass 108 comprises an airplane figure (vehicle figure) 111 and a dummy compass card 112 (with reference to FIG. 4).

The airplane figure 111 is fixedly provided on a transparent plate 110 provided at a window of the controller 100.

Figure 4:
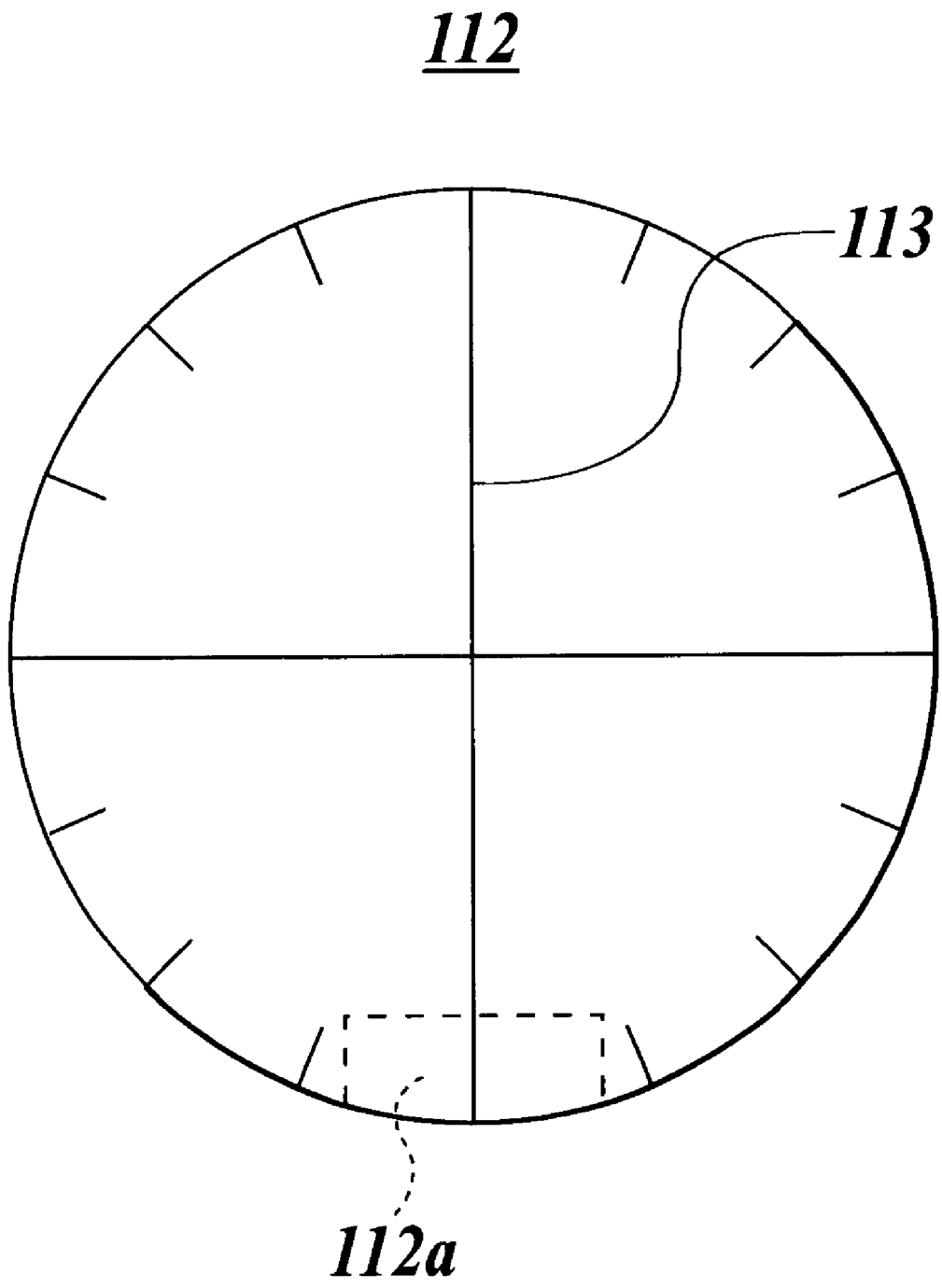
FIG. 4 is a view showing a dummy compass card of the controller shown in FIG. 1.

The dummy compass card 112 is provided at the inside of the window of the controller 100 and rotatable on the pendulum principal according to the tilt direction of the controller 100. In FIG. 4, the dummy compass card 112 is shown. As shown in FIG. 4, a cross line (lubber line) 113 crossed at the center of the dummy compass card 112 is indicated at the dummy compass card 112. The travel direction of the model airplane 200 is indicated by the position relation between the cross line 113 and the airplane figure 111. In FIG. 4, the reference numeral 112*a* denotes a weight by which the dummy compass card 112 operates as a pendulum.

Figure 5:
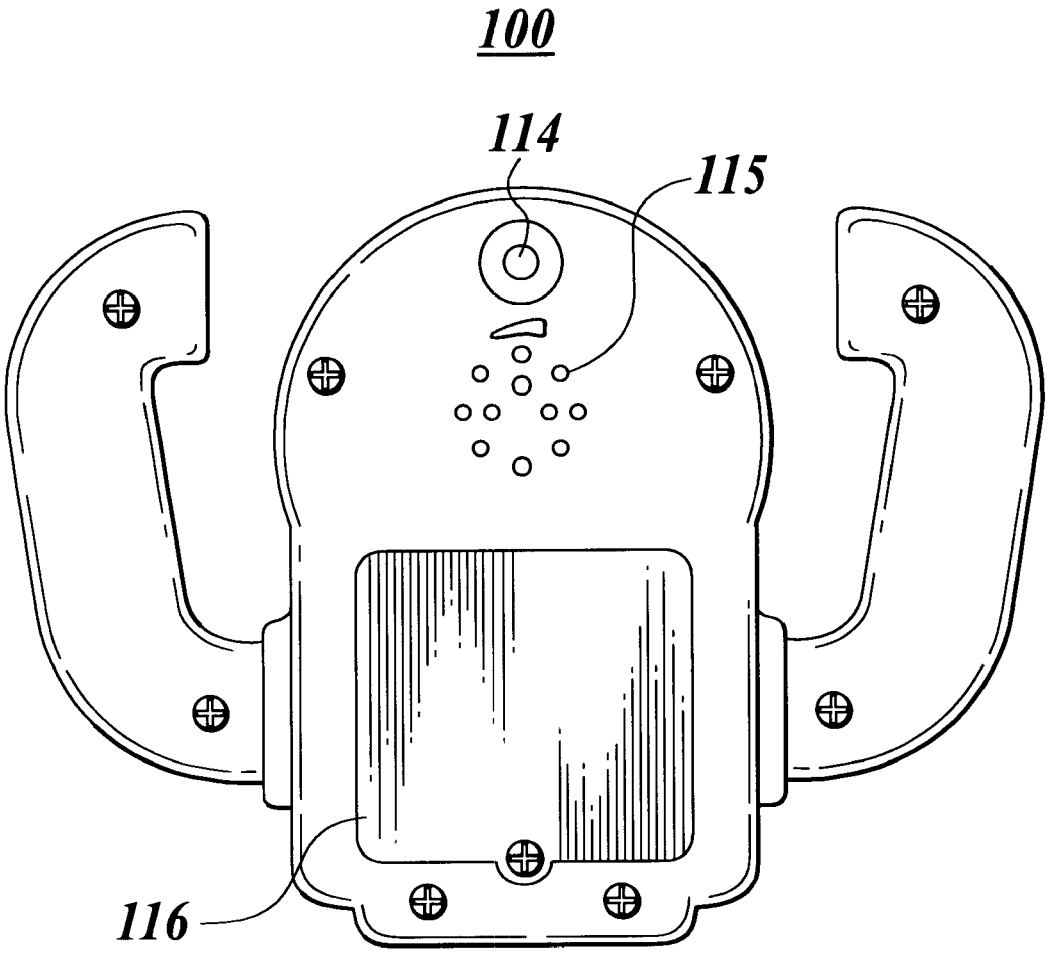
FIG. 5 is a rear elevation view of the controller shown in FIG. 1.

The structure of the rear surface of the controller 100 will be explained with reference to FIG. 5. In FIG. 5, the rear elevation view of the controller 100 is shown.

As shown in FIG. 5, the controller 100 comprises an emitter (light emitting diode) 114 of an infrared light, for functioning as a transmitter unit and holes 115 for emitting a sound which are provided at the rear surface side of the body thereof. At the inside of the hole 115 for emitting a sound, a speaker is provided. In FIG. 5, the reference numeral 116 denotes a cover of a battery containing chamber for containing an electric battery therein.

Figure 6:
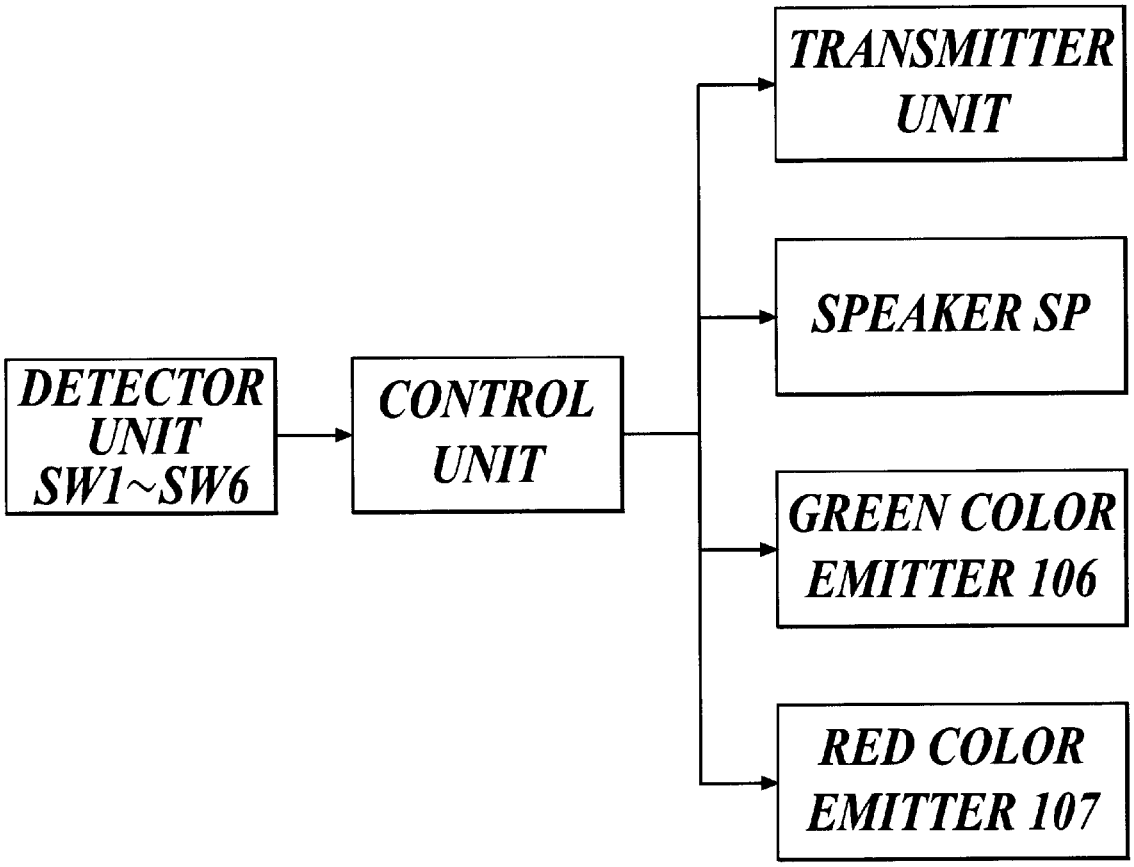
FIG. 6 is a block diagram showing an internal circuit of the controller shown in FIG. 1.

The internal structure of the controller 100 will be explained with reference to FIG. 6. In FIG. 6, the internal circuit of the controller 100 is shown.

As shown in FIG. 6, the controller 100 comprises a switch SW 1 for detecting whether the power supply switch 101 is turned on or off, switches SW 2 and SW 3 for detecting whether the buttons 104 is pressed or not, a switch SW 4 for detecting whether the button 105 is pressed or not, and switches SW 5 and SW 6 for detecting whether the dummy compass card 112 is rotated or not, which are provided at the internal portion thereof.

The switch SW 2 is turned on when the upper button for moving the model airplane 200 forward, of the buttons 104 is pressed. The switch SW 3 is turned on when the lower button for moving the model airplane 200 backward, of the buttons 104 is pressed. The switch SW 4 is turned on when the button 105 is pressed. The switch SW 5 is turned on when the dummy compass card 112 is tilted leftward, that is in a counterclockwise direction about the horizontal axis, and the switch is turned on when the dummy compass card 112 is tilted rightward, that is a clockwise direction about the horizontal axis.

The switches SW 5 and SW 6 will be explained in more detail, as follows. For example, a projection or the like is formed at the predetermined position on the rear surface of the dummy compass card 112. The projection or the like hits against each of moveable armatures (there is a case that the moveable armatures are in common) of the switches SW 5 and SW 6 according to the rightward or leftward rotation of the dummy compass card 112. Thereby, it is possible to provide the controller 100 having a structure that each of the switches SW 5 and SW 6 is turned on selectively.

Further, as shown in FIG. 6, according to the internal circuit of the controller 100, the detector unit composed of the switches SW 1 to SW 6 as described above outputs the detect signal to the control unit. The control unit outputs the control signal to the speaker SP, the green color emitter 106 and the red color emitter 107 on the basis of the detect signal, to control them individually, as described above. Further, the control unit outputs the control signal to the transmitter unit such as the emitter 114. Thereafter, the transmitter unit transmits the control signal to the model airplane 200 to operate it.

Next, the structure of the model airplane 100 will be explained in detail, as follows.

Figure 7:
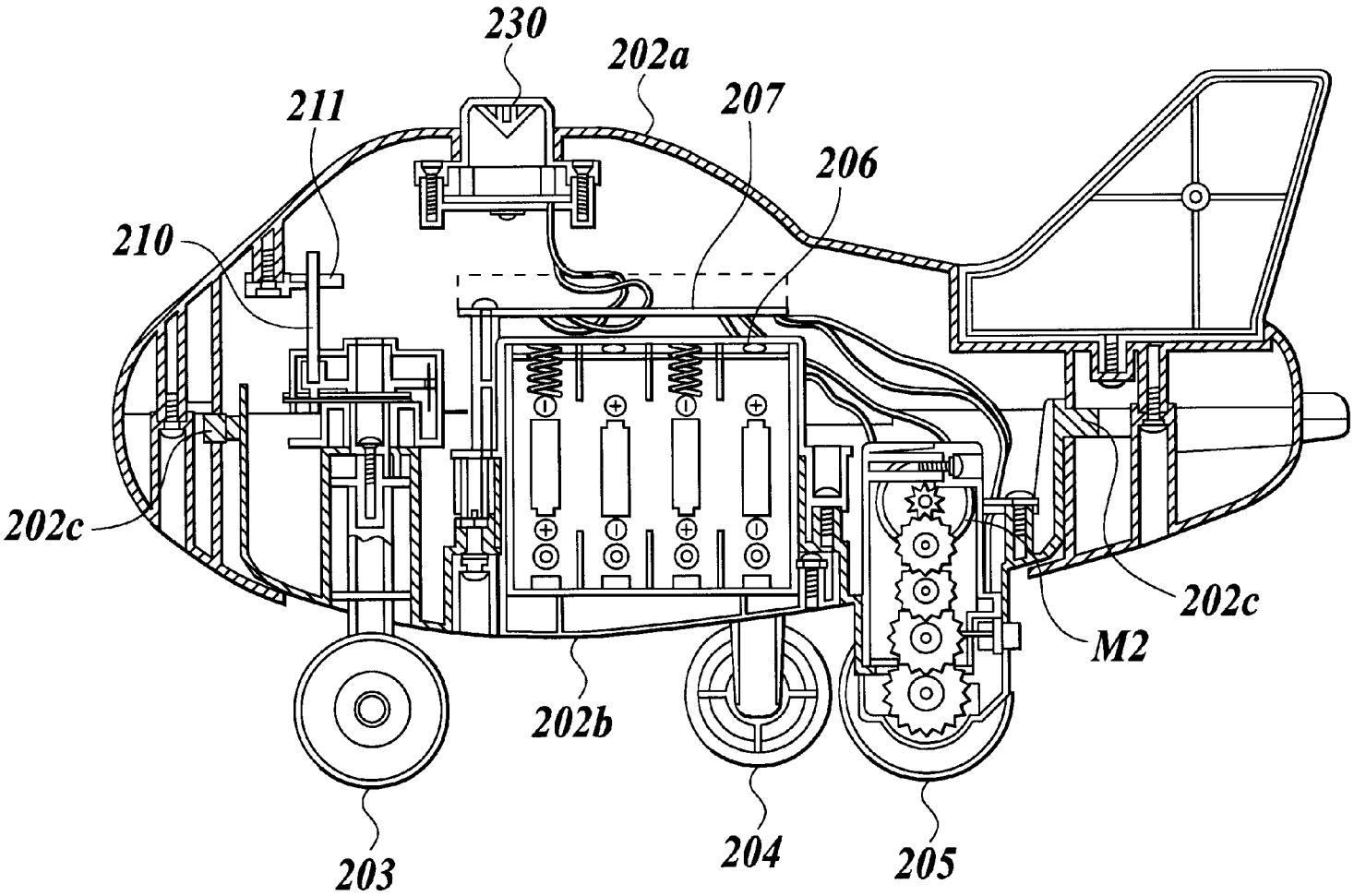
FIG. 7 is a vertical sectional view shown from a right side surface of the model airplane shown in FIG. 2.

In FIG. 7, the vertical sectional view shown from the right side surface of the model airplane 200 is shown.

As shown in FIG. 7, the body of the model airplane 200 is composed of the upper body part 202*a* and the lower body part 202*b*.

The upper body part 202*a* has a structure so that the upper body part 202*a* can be tilted rightward and leftward, that is in a clockwise direction and a counterclockwise direction, around the shaft 202*c* provided at the front position and the rear position of the lower body part 202*b*. Further, the upper body part 202*a* is composed of the upper and lower parts put together through screws.

The lower body part 202*b* comprises the front wheel 203, a middle wheel 204 and a rear wheel 205 which are provided thereto. The front wheel 203 and the middle wheel 204 are composed as a wheel capable of running idle. On the other hand, the rear wheel 205 is composed as a drive wheel.

Further, the lower body part 202*b* comprises a battery containing box 206 provided thereto. The battery containing box 206 can contain four batteries therein. Further, the lower body part 202*b* comprises a print wiring board 207 attached right above the battery containing box 206. Various types of circuit parts are attached on the print wiring board 207. Further, the lower body part 202*b* comprises a motor M1 (with reference to FIG. 8) and a motor M2 provided at the front position and the rear position thereof, respectively.

Figure 8:
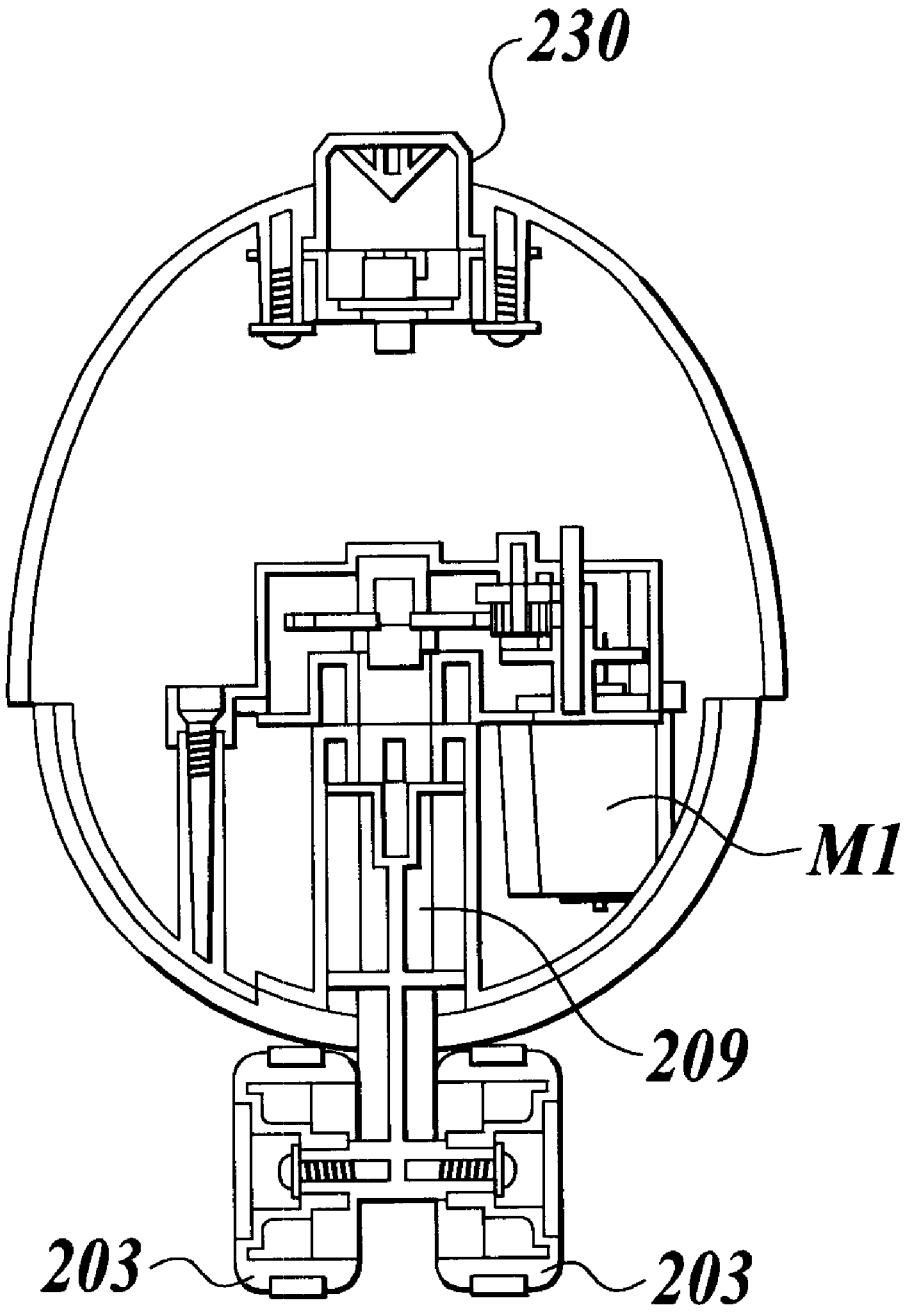
FIG. 8 is a vertical sectional view of a front wheel part shown from a front side of the model airplane shown in FIG. 2.

In FIG. 8, the vertical sectional view of the front wheel 203 and the periphery thereof, shown from the front side of the model airplane 200 is shown.

As shown in FIG. 8, the motor M1 changes the direction of the front wheel 203 in order to steer the model airplane 200 and the tilt direction of the upper body part 202*a* in order to tilt the upper body part 202*a* to the lower body part 202*b*.

Figure 9:
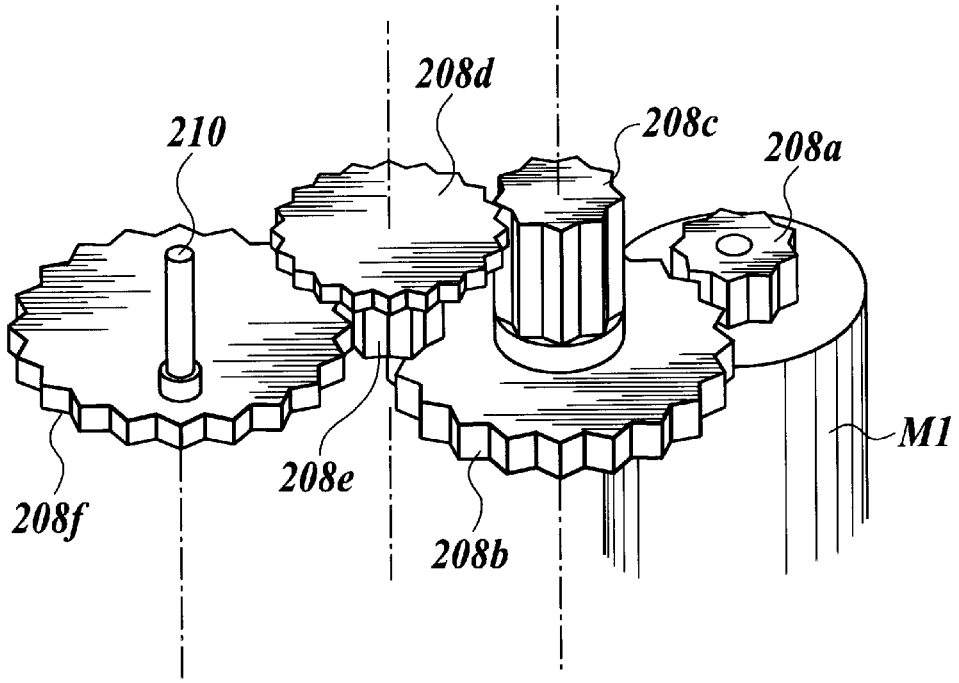
FIG. 9 is a view showing a mechanism of a steering unit of the front wheel of the model airplane shown in FIG. 2.
Figure 9:
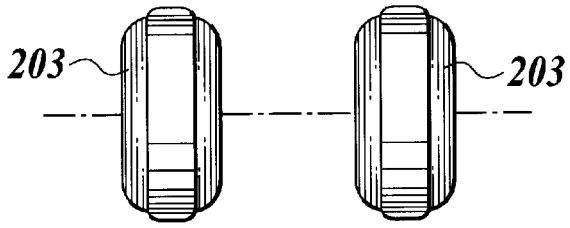

In FIG. 9, the mechanism of the steering unit of the front wheel 203 of the model airplane 200 is shown.

As shown in FIG. 9, the motor M1 is connected with the gear 208*f* through the gears 208*a* to 208*e*. The horizontal portion of the gear 208*f* is fixed at the vertical portion of the wheel holder 209 to support the front wheel 203. As a result, when the motor M1 runs, the front wheel 203 is rotated rightward or leftward, that is in a clockwise direction or a counterclockwise direction, according to the rotational direction of the rotor of the motor M1.

Figure 10:
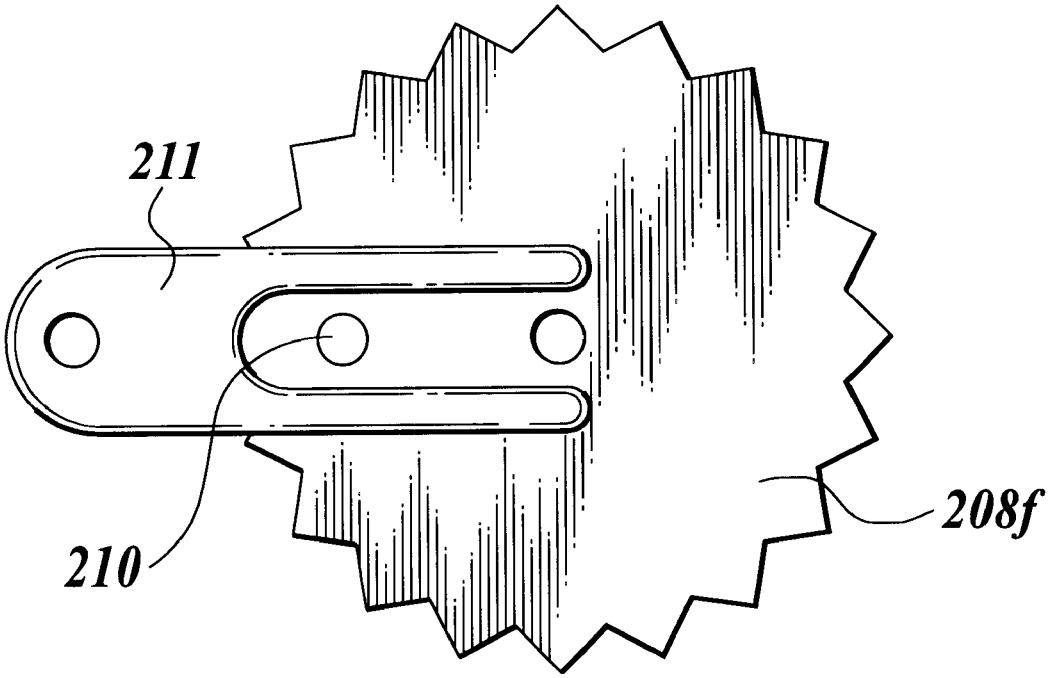
FIG. 10 is a fragmentary top plane view showing a mechanism of a tilt unit of the model airplane shown in FIG. 2.

In FIG. 10, the mechanism of the tilt unit of the upper body part 202*a* of the model airplane 200 is shown.

As shown in FIG. 9 and FIG. 10, a rod 210 is provided in standing at the eccentric position of the gear 208*f*. The upper portion of the rod 210 is positioned at a crotch portion of a forked member 211 fixed at the internal surface of the upper body part 202*a*, as shown in FIG. 7 and FIG. 10. As a result, when the motor M1 runs, the rod 210 is moved rightward and leftward according to the rotational direction of the rotor of the motor M1, thereby the upper body part 202*a* of the model airplane 200 is tilted rightward and leftward through the forked member 211.

Figure 11:
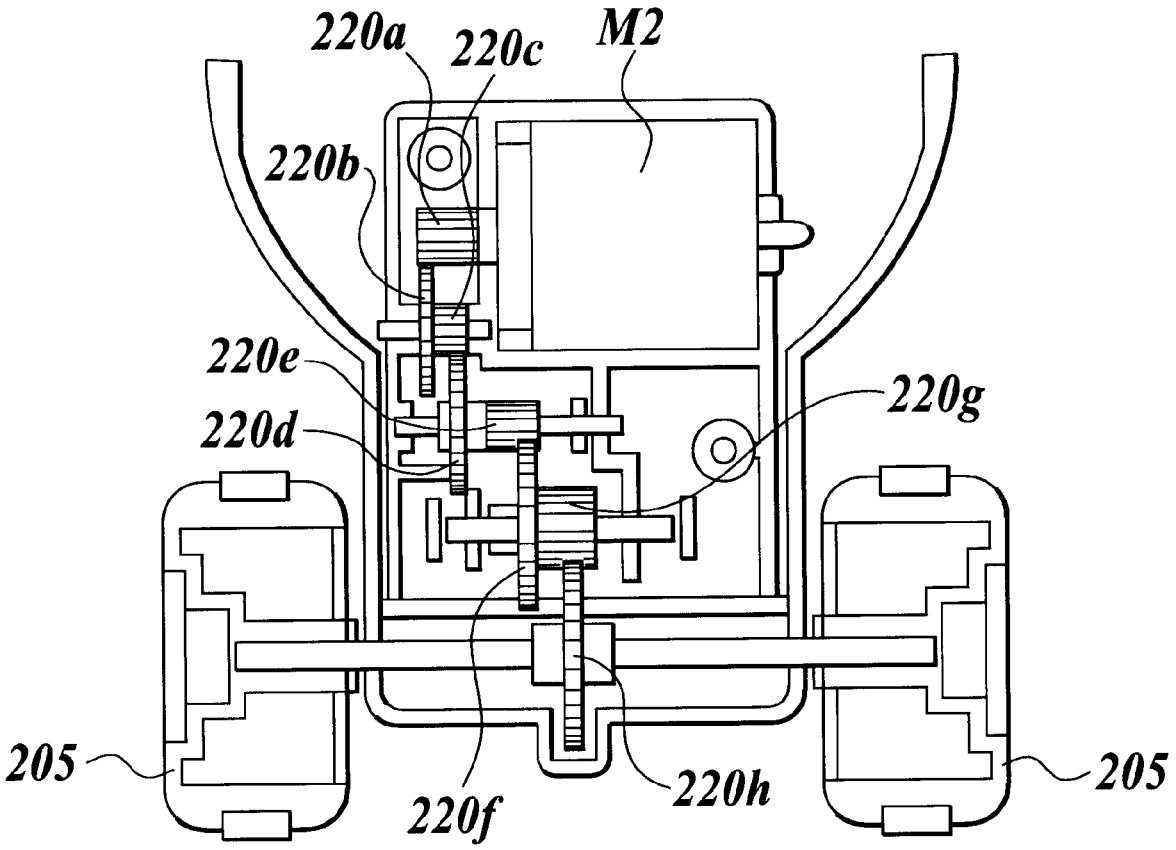
FIG. 11 is a vertical sectional view of a rear wheel part shown from a front side of the model airplane shown in FIG. 2.

In FIG. 11, the vertical sectional view of the rear wheel 205 and the periphery thereof, shown from the front side of the model airplane 200 is shown.

As shown in FIG. 11, the motor M2 changes the rotational direction of the rear wheel 205 in order to move the model airplane 200 forward and backward.

That is, the motor M2 is connected with the rear wheel 205 through the gears 220*a* to 220*h*. As a result, when the motor M2 runs, the rear wheel 205 is rotated according to the rotational direction of the rotor of the motor M2.

The gears 220*f* and 220*g* are composed as one. Further, the gears 220*f* and 220*g* can be moved with the shaft thereof in the direction that the shaft line is extended, according as the power supply switch 201 is turned on or off. When the power supply switch 201 is turned off, the gears 220*g* and 220*h* are released from being engaged with each other so that it is possible to move the model airplane 200 manually. When the power supply switch 201 is turned on, the gears 220*g* and 220*h* are engaged with each other so that it is possible to transmit the motor power of the motor M2 to the rear wheel 205.

As shown in FIG. 2 and FIG. 7, the model airplane 200 comprises a receiver unit 230 provided at the upper position of the upper body part 202*a* thereof. Further, the model airplane 200 comprises a red color emitter 221 and a green color emitter 222 comprising LED as a light source respectively, provided at the front edges of the both of wings, respectively. When the power supply switch 201 is turned on, both of the red color emitter 221 and the green color emitter 222 light in synchronization with each other.

Figure 12:
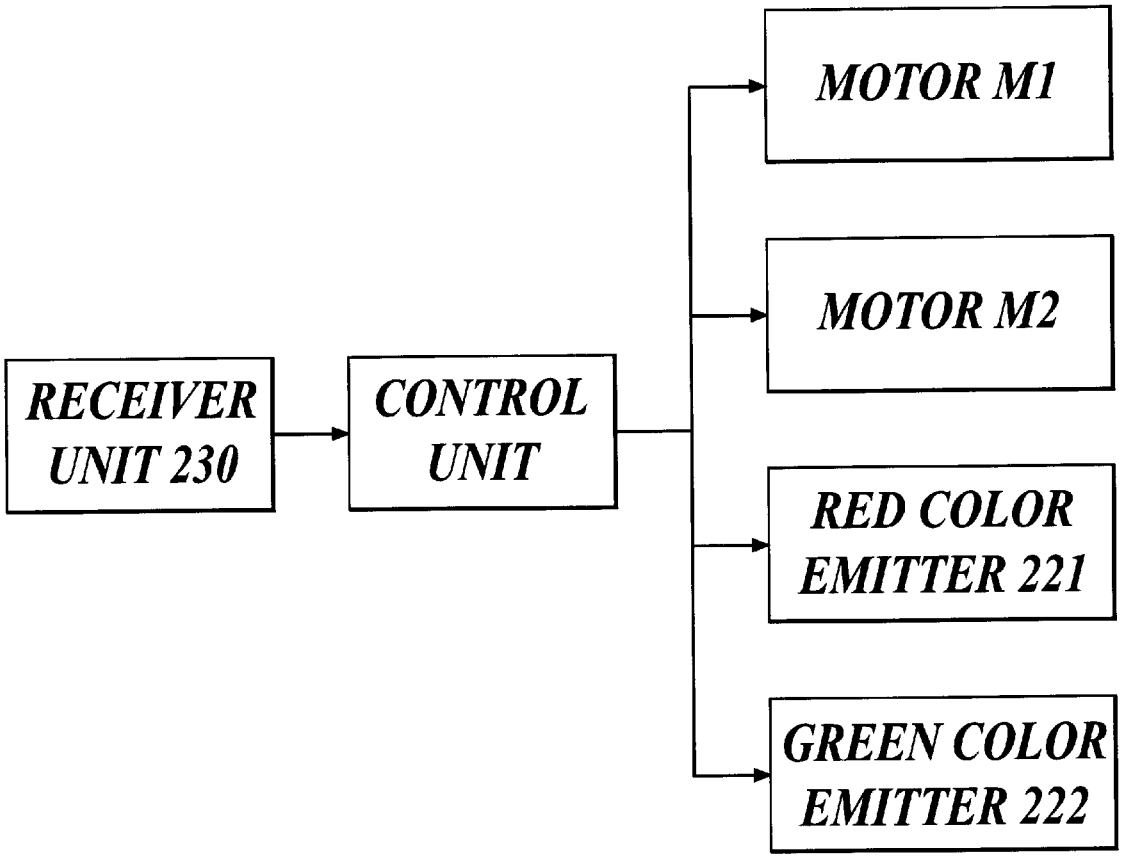
FIG. 12 is a block diagram showing an internal circuit of the model airplane shown in FIG. 2.

In FIG. 12, the internal circuit of the model airplane 200 is shown.

As shown in FIG. 12, according to the internal circuit of the model airplane 200, the receiver unit 230 receives the control signal from the transmitter unit of the controller 100, thereafter outputs the control signal to the control unit. The control unit outputs the control signal to the motor M1, the motor M2, the red color emitter 221 and the green color emitter 222 on the basis of the control signal, to control various types of mechanisms (loads) as described above individually.

Although the present invention has been explained according to the above-described embodiment, it should also be understood that the present invention is not limited to the embodiment and various changes and modifications may be made to the invention without departing from the gist thereof.

According to the present invention, a main effect can be obtained, as follows.

The toy comprises the remote control device and the remote controlled model vehicle capable of turning at least rightward and leftward according to the control signal from the remote control device, wherein the remote control device comprises: the tilt detecting unit for detecting rightward and leftward tilt directions thereof; and the remote controlled model vehicle comprises: the lower body part; the upper body part capable of tilting rightward and leftward to the lower body part; the tilting unit for tilting the upper body part in the same direction as the tilt direction of the remote control device, detected by the tilt detecting unit; and the steering unit for turning in the same direction as the tilt direction of the remote control device in synchronization with the tilt of the upper body part. Accordingly, it is possible to provide a toy comprising a remote control device and a remote controlled model vehicle capable of moving with reality. Further, it is possible to sufficiently provide senses that a player pilots a real airplane at a cockpit thereof.

The entire disclosure of Japanese Patent Application No. Tokugan hei-11-155767 filed on Jun. 2, 1999 including specification, claims, drawings and summary are incorporated herein by reference in its entirety.

What is claimed is:

1. A toy comprising a remote control device and a remote controlled model vehicle capable of turning at least rightward and leftward according to a control signal from the remote control device, wherein the remote control device comprises: a tilt detecting unit for detecting rightward and leftward tilt directions thereof; and the remote controlled model vehicle comprises: a lower body part; an upper body part capable of tilting rightward and leftward to the lower body part; a tilting unit for tilting the upper body part in the same direction as a tilt direction of the remote control device, detected by the tilt detecting unit; and a steering unit for turning in the same direction as the tilt direction of the remote control device in synchronization with a tilt of the upper body part.

2. A toy comprising a remote control device and a remote controlled model vehicle, according to claim 1;

wherein the remote controlled model vehicle further comprises: a wheel provided at the lower body part, as the steering unit; and a shaft extending forward and backward thereof and provided at the lower body part, around which the upper body part is capable of tilting rightward and leftward; and a direction of the wheel and a tilt direction of the upper body part is determined according to the tilt direction of the remote control device, detected by the tilt detecting unit.

3. A toy comprising a remote control device and a remote controlled model vehicle, according to claim 1, wherein the remote control device further comprises at least a handle provided thereat and held by a hand to operate the remote control device.

4. A toy comprising a remote control device and a remote controlled model vehicle, according to claim 1, wherein the remote control device further comprises a dummy compass for indicating rightward and leftward tilt directions of the remote control device and a travel direction of the remote controlled model vehicle indirectly.

5. A toy comprising a remote control device and a remote controlled model vehicle, according to claim 4, wherein the dummy compass comprises: a vehicle figure fixedly provided at a transparent plate provided at a window of the remote control device; a compass card provided at an inside of the window of the remote control device and rotatable on a basis of a pendulum principal according to rightward and leftward tilts of the remote control device; and a predetermined lubber line provided at the compass card, for indicating the travel direction of the remote controlled vehicle by a position relation with the vehicle figure.

6. A toy comprising a remote control device and a remote controlled model vehicle capable of turning at least rightward and leftward according to a control signal from the remote control device, wherein the remote control device comprises: a tilt detecting unit for detecting rightward and leftward tilt directions thereof; and the remote controlled model vehicle comprises: a body capable of tilting rightward and leftward; a tilting unit for tilting the body in the same direction as a tilt direction of the remote control device, detected by the tilt detecting unit; and a steering unit for turning in the same direction as the tilt direction of the remote control device in synchronization with a tilt of the body.

7. A toy comprising a remote control device and a remote controlled model vehicle, according to claim 6, wherein the remote controlled model vehicle further comprises a wheel provided at the body, as the steering unit.

8. A toy comprising a remote control device and a remote controlled model vehicle, according to claim 6, wherein the remote control device further comprises at least a handle provided thereat and held by a hand to operate the remote control device.

9. A toy comprising a remote control device and a remote controlled model vehicle, according to claim 6, wherein the remote control device further comprises a dummy compass for indicating a travel direction of the remote controlled model vehicle.

10. A toy comprising a remote control device and a remote controlled model vehicle, according to claim 9, wherein the dummy compass comprises: a vehicle figure fixedly provided at a transparent plate provided at a window of the remote control device; a compass card provided at an inside of the window and rotatable on a basis of a pendulum principal according to rightward and leftward tilts of the remote control device; and a predetermined lubber line provided at the compass card, for indicating the travel direction of the remote controlled vehicle by a position relation with the vehicle figure.

* * * * *